US009881466B2

(12) United States Patent
Zarnowski et al.

(10) Patent No.: US 9,881,466 B2
(45) Date of Patent: Jan. 30, 2018

(54) ANNULAR LIGHT SYSTEM

(71) Applicants: Terry L. Zarnowski, Fulton, NY (US); Michael A. Marley, Liverpool, NY (US)

(72) Inventors: Terry L. Zarnowski, Fulton, NY (US); Michael A. Marley, Liverpool, NY (US)

(73) Assignee: UNIMAR, INC., North Syracuse, NY (US)

( * ) Notice: Subject to any disclaimer, the term of this patent is extended or adjusted under 35 U.S.C. 154(b) by 250 days.

(21) Appl. No.: 14/919,762

(22) Filed: Oct. 22, 2015

(65) Prior Publication Data

US 2017/0116864 A1 Apr. 27, 2017

(51) Int. Cl.

| | |
|---|---|
| ***F21V 13/04*** | (2006.01) |
| ***F21V 5/04*** | (2006.01) |
| ***F21V 7/04*** | (2006.01) |
| ***G08B 5/36*** | (2006.01) |
| ***F21V 7/06*** | (2006.01) |
| ***F21V 29/70*** | (2015.01) |
| *F21V 7/00* | (2006.01) |
| *G08G 5/00* | (2006.01) |
| *F21Y 103/33* | (2016.01) |
| *F21Y 113/10* | (2016.01) |
| *F21W 111/00* | (2006.01) |

(Continued)

(52) U.S. Cl.

CPC ..... *G08B 5/36* (2013.01); *F21V 7/06* (2013.01); *F21V 29/70* (2015.01); *F21V 5/045* (2013.01); *F21V 7/0025* (2013.01); *F21W 2111/00* (2013.01); *F21Y 2103/33* (2016.08); *F21Y 2107/30* (2016.08); *F21Y 2113/10* (2016.08); *F21Y 2115/10* (2016.08); *G08G 5/0026* (2013.01)

(58) Field of Classification Search

CPC ..... F21Y 2105/00; F21Y 2105/18; F21W 2101/06; F21W 2111/06; F21W 2131/107; F21V 5/046; F21V 7/043; F21V 13/04

See application file for complete search history.

(56) References Cited

U.S. PATENT DOCUMENTS 5,155,666 A 10/1992 Radford et al.
5,557,257 A * 9/1996 Gieffers ..... B60Q 1/2611 340/384.3

(Continued)

*Primary Examiner* — Ismael Negron
(74) *Attorney, Agent, or Firm* — Bernhard P. Molldrem, Jr.

(57) ABSTRACT

A beacon or annular light generator assembly includes a top cover and an associated bottom cover centered on a vertical axis with a ring of light-emitting elements situated between the top and bottom covers. Upper and lower reflectors are integrated into the lower side of the top cover and into the upper side of the lower cover. These reflectors are surfaces of rotation, about the vertical axis, of a horizontal parabola whose focus lies substantially on the ring of light-emitting elements. A cylindrical collimating lens lies radially outside the ring of light-emitting elements, and concentrates the center portion of the light onto the horizontal plane. Light outside the center portion is redirected by the upper and lower reflectors parallel to the horizontal plane. A multiple array may be formed of two or more such annular light generator assemblies stacked upon one another.

14 Claims, 6 Drawing Sheets

(51) Int. Cl.
*F21Y 115/10* (2016.01)
*F21Y 107/30* (2016.01)

(56) References Cited

U.S. PATENT DOCUMENTS 5,694,112 A * 12/1997 VannRox ..... B60Q 1/2611 340/468
5,899,557 A * 5/1999 McDermott ..... F21V 5/046 362/244
6,543,911 B1 * 4/2003 Rizkin ..... F21V 5/046 362/240
6,616,291 B1 * 9/2003 Love ..... F21V 5/04 315/185 R
6,667,582 B1 * 12/2003 Procter ..... F21V 5/04 313/113
6,989,768 B2 1/2006 DeMarco et al.
7,079,041 B2 * 7/2006 Fredericks ..... B64D 47/06 340/321
7,568,821 B2 8/2009 Peck et al.
7,642,730 B2 * 1/2010 Dowling ..... H05B 37/02 315/292
8,096,677 B2 1/2012 Fields et al.
8,177,597 B2 * 5/2012 Kolb ..... F21V 5/046 445/22
8,220,959 B2 7/2012 Rizkin et al.
8,591,073 B2 11/2013 Peck et al.
8,926,148 B2 1/2015 Shumate et al.
8,979,347 B2 * 3/2015 Holman ..... F21V 7/0058 362/230
8,992,049 B2 3/2015 McDade et al.
9,016,896 B1 4/2015 Roudeski
2004/0032745 A1 * 2/2004 Pederson ..... B60Q 1/2611 362/545
2005/0047167 A1 * 3/2005 Pederson ..... B60Q 1/2611 362/542
2005/0057941 A1 * 3/2005 Pederson ..... B60Q 1/2611 362/542
2007/0164875 A1 7/2007 Fredericks et al.
2010/0091507 A1 4/2010 Li et al.
2015/0098221 A1 4/2015 Di Giovine

* cited by examiner

ANNULAR LIGHT SYSTEM

BACKGROUND OF THE INVENTION

This invention relates to a beacon, i.e., a lighting device that concentrates emitted light onto a horizontal plane, and which can be used as a marker or aviation obstruction beacon to help identify towers, tall building, smokestacks or the like that may rise to an elevation of one hundred fifty feet to several hundred feet and pose a hazard to aircraft navigation. The invention is more specifically directed to a beacon or light generator that efficiently directs light generally omni-directionally along a horizontal plane to form a horizontal disk of light, or a portion of a disk of light, within some small angle Theta (θ) from the horizontal. The invention also concerns construction of the beacon in which a ring light emitter or a ring of emitters, such as LEDs, are arranged between upper and lower reflectors of a generally parabolic profile, and with a collimating lens circling around the ring of emitters to direct the central portion of the light onto the horizontal plane, with the remaining light that is above or below the collimating lens being directed by the upper and lower reflectors onto the horizontal plane.

A need has long existed for a beacon that is efficient and reliable, and which can be easily installed on a tall building, smoke stack, tower, or other elevated structure, and which is of robust construction. A need has also long existed for a beacon with improved heat management for the lighting and for the electrical power drive circuits for the lighting.

A number of beacons have been proposed in which light-emitting diodes or LEDs are arranged to provide illumination, and with focusing reflectors, in the form of a conic section, that direct the light from the LEDs onto the horizontal plane. Other beacons are provided with a lens or prism of glass or clear plastic which focuses or collimates a central part of the illumination, and which redirects the remaining part of the light using total internal reflection within the prism. These arrangements are complex and expensive to construct, and do not conduct the heat away from the light emitting devices, thus limiting the power that can be applied to the beacon.

OBJECTS AND SUMMARY OF THE INVENTION

Accordingly it is an object of this invention to provide a beacon arrangement that is convenient and simple to install and use, and with reliable robust construction with good heat management and which represents a significant improvement over the prior art.

It is a more particular object to provide a beacon or light generator arrangement in the form of a light engine incorporating a light source, opposing reflectors, a lens, heat sink, housing and cover to generate light that is narrowly focused onto a first spatial plane (typically, horizontal) and is uniformly spread as a disk of light about an axis that is substantially perpendicular to the first spatial plane. Favorably, the light source can be one or a plurality of small light sources such as s Light Emitting Diodes (LEDs).

Another object is to provide an annular (or arcuate) lens that is positioned to focus or collimate a first or central portion of light from the light source in only the first spatial plane, and a related object to provide upper and lower reflector surfaces on opposite sides of the first spatial plane and arranged to direct a substantial portion of the remaining light outside of the central portion such that the reflected light joins with the light collimated by the lens to form a composite narrow beam in the first spatial plane.

A further object is to construct the beacon such that the upper and lower reflective surfaces are integrated with a top and bottom cover of the beacon light, and with the covers serving as a heat sink for the light sources. The covers can also combine with a generally cylindrical clear lens beyond the two reflective surfaces to create an environmentally sealed system.

An important object is to create a beacon arrangement that can serve as a navigational aid in which the light emitted therefrom is concentrated to occur within narrow flat region generally perpendicular to the vertical (i.e., horizontally within some small angle θ) and can be seen over a wide angle, or multiple angles in the horizontal plane, and in some cases over a full 360 degrees in the horizontal plane.

The invention can also be used in many applications where light needs to be narrowly concentrated in one given plane and yet be widely visible about an axis perpendicular to that given plane.

In accordance with an aspect of this invention, a beacon emits a substantially flat horizontal disk of light (or portion of a disk of light) along a horizontal plane. The beacon has a top cover and a bottom cover, each situated to be centered on a vertical axis of the beacon. An arrangement of light generating devices, e.g., a plurality of light-emitting diodes (LEDs) arranged in a ring or arc situated between the top cover and the bottom cover, and each of said light generating devices has a light-emitting surface (LES) facing radially outward in respect to the vertical axis. There are upper and lower reflective surfaces integrated into the lower side of the top cover and into the upper side of the lower cover, respectively, and with each of these reflective surfaces being a surface of rotation, about the vertical axis, of a horizontal parabola whose focus lies substantially on the ring of light generating devices. A cylindrical collimating lens is centered on the vertical axis and lies radially outside the ring of light generating devices, and is aligned with the horizontal plane where the light generating devices are positioned, such that the lens collimates a center portion of the light emanating from the LES of these devices onto the horizontal plane. The light above and below this central portion, which misses the collimating lens, impinges upon the upper and lower reflective surfaces which direct that light substantially parallel to the horizontal plane. The ring (or arc) of light generating devices can include LEDs all emitting a single color wavelength, or can include LEDs that emit a number of different wavelengths. In many cases, the light may be outside the visible spectrum, e.g., infrared.

Favorably, a heat sink may be incorporated into one or both of the top and bottom covers. In an illustrative construction, the reflective surfaces, the ring of said light generators and the cylindrical collimating lens each can extend in a full circle about the vertical axis. In other beacon arrangements, these elements may extend only for an arc of less than a full circle, e.g., 180 degrees.

In a preferred arrangement, an outer cylindrical light-transmitting lens is disposed radially beyond the cylindrical collimating lens, and is sealably affixed onto radially outer portions of the top cover and bottom cover.

A mounting bracket may be affixed onto one or both of the top cover and the bottom cover, and is adapted for attaching the beacon onto an elevated structure.

Another illustrative embodiment of the beacon is of a stacked, twin-beacon structure that emits substantially flat upper and lower horizontal disks of light along respective horizontal planes one above the other. Here, a first top cover and a first bottom cover are each situated to be centered on a vertical axis of the beacon. A first plurality of light-emitting diodes (LEDs) are arranged in a first ring (full or partial) situated between the first top and bottom covers, and with each of the LEDs thereof having a light-emitting surface (LES) facing radially outward in respect to the vertical axis. First upper and lower reflective surfaces are integrated into the lower side of the first top cover and into the upper side of the first lower cover, respectively. Each of these first reflective surfaces may be considered a surface of rotation, about the vertical axis, of a horizontal parabola whose focus lies on such ring of LEDs. A first cylindrical collimating lens centered on the vertical axis and lying radially outside the ring of the afore-mentioned first plurality of LEDs. In this way, the lens collimates a center portion of the light emanating from the LES of said LEDs onto the first horizontal plane, and with light thereof outside the center portion impinging upon the first upper and lower reflective surfaces and being directed substantially parallel to said first horizontal plane;

For the stacked portion of the beacon, there are a second top cover and a second bottom cover, each situated to be centered on the vertical axis of the beacon, the second top cover being situated adjacent the first lower cover (in some embodiments these two covers may be integrated). In other embodiments, there can be a stack of three or more such beacons.

A second plurality of light-emitting diodes (LEDs) are arranged in a second ring (or arc) which is situated between the second top and bottom covers, and with each of the LEDs thereof having a light-emitting surface (LES) facing radially outward in respect to the vertical axis. Second upper and lower reflective surfaces are integrated into the lower side of the second top cover and into the upper side of the second bottom cover, respectively. Each of the second reflective surfaces are surfaces of rotation, about said vertical axis, of a horizontal parabola whose focus lies substantially on the second ring of LEDs or other emitter(s). A second cylindrical collimating lens is centered on vertical axis and lying radially outside second ring of the second plurality of LEDs, such that the lens collimates a center portion of the light emanating from the LES of the LEDs onto the second horizontal plane. The light outside center portion impinges upon the second upper and lower reflective surfaces and is directed therefrom substantially parallel to the second horizontal plane.

The LEDs of each of the first and second plurality of LEDs all emit a respective single color wavelength, and the LEDs of the first plurality of LEDs can emit one predetermined color and the LEDs of the second plurality of LEDs emit a different predetermined color, e.g., one red, one green, or one red and one white. Alternatively, the LEDs of each of the first and second plurality of LEDs can all emit a single color wavelength, and the LEDs of the first plurality of LEDs emit one predetermined color and the LEDs of the second plurality of LEDs emit the same predetermined color.

As an alternative construction the LEDs of each of first and second plurality of LEDs may emit a combination of different color wavelengths.

In a favorable arrangement of the beacons of this invention, an electronic drive arrangement provides power to the LEDs of the first and second pluralities of LEDs for illuminating the same. The electronic drive arrangement may be configured to provide power continuously or intermittently to each of the first and second pluralities of LEDs. In the latter case, the drive arrangement may be adapted to illuminate the first and second pluralities of LEDs alternately in a programmed pattern.

These and many other objects, features, and advantages of the beacon of this invention will become apparent from the ensuing detailed description of a preferred embodiment, when read in conjunction with the accompanying Drawing.

DETAILED DESCRIPTION OF THE PREFERRED EMBODIMENT(S)

Figure 1:
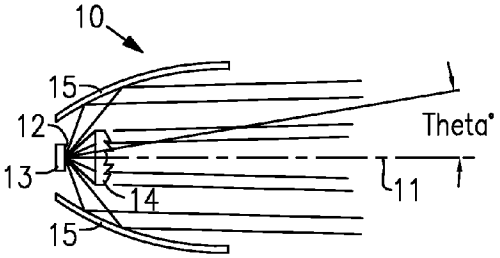
FIG. 1 is a cross section across a vertical plane of optical components for beacons according to the principles of the present invention.
Figure 2:
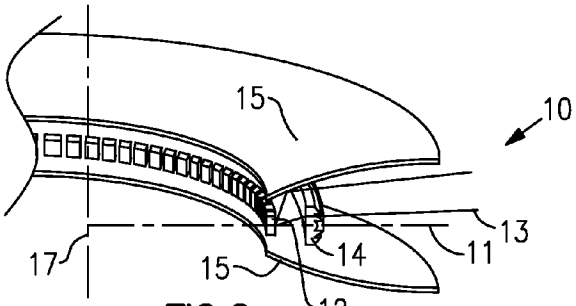
FIG. 2 shows a partial perspective view of the optical components thereof.
Figure 3:
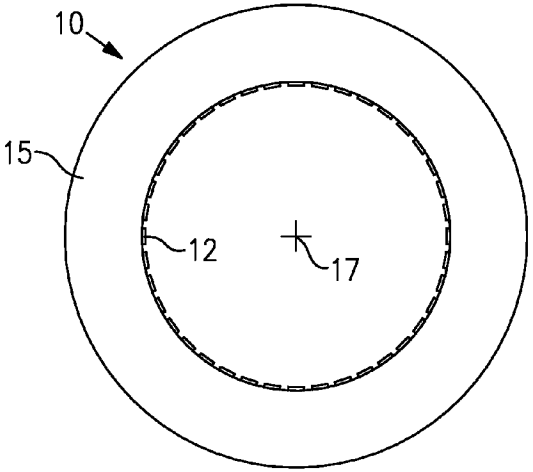
FIG. 3 is a vertical cross sectional view thereof of the optical components showing the elements extending a full 360 degrees in a horizontal plane and about a vertical axis.
Figure 4:
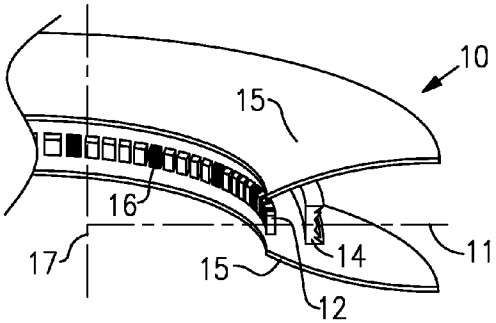
FIG. 4 is a partial perspective view similar to FIG. 2, featuring light sources of two or more different colors.

With reference to the Drawing, and initially to FIGS. 1 through 4, a beacon or light generator 10 is provided for emitting visible light radially outward in a horizontal plane (or within a wedge of an angle theta of a few degrees) and generally omnidirectional, i.e. over a full circle of 360 degrees. The same principles would apply to a to a beacon or light generator that emits light over a smaller arc, e.g., 180 degrees, or one which directs its light downward a few degrees from the horizontal, i.e., along a conic surface below the horizontal, or likewise along a conic surface oriented above the horizontal. The general principles can be explained initially with FIGS. 1 to 3. FIG. 1 is a cross sectional elevation of the principal parts of the beacon 10, here considered as light generator, lens and reflector all considered to have an optic axis 11 (in the plane of the drawing) that is horizontal. In practice, the light generator, lens and reflectors follow an arc in the horizontal plane, so that the optic axis 11 sweeps out at least a portion of the horizontal plane. The light generator includes an arcuate band of LEDs 13 that lie along a circle or arc, each having a light emitting surface or LES 12 facing radially outward. The LES 12 for each emitter has a finite height. An annular or cylindrical collimating lens 14, in this case a Fresnel collimating lens, lies radially outside of the LESs 12 of the band of LEDs 13, and serves to focus a central portion of the light coming from the LEDs. Other equivalent collimating lenses can be used instead, such as an asphere. As seen here the lens 14 has a finite height extending above and below the horizontal plane (or optic axis) 11, so some of the light emitted from the LESs 12 will pass above or below the upper and lower limits of the lens 14, and this light will be incident on a pair of reflectors, i.e., upper and lower parabolic reflectors 15, 15. These reflectors each have a reflective surface that is at least a portion of a surface or rotation about a vertical axis 17 of the beacon, in this case a surface of rotation of a horizontal parabola in which the focus(es) are along the circle of the LEDs 13. These two reflectors 15 redirect the light from the upper and lower parts of the LES's onto a direction that is substantially parallel with the horizontal plane. Ultimately, the light that is emitted from the beacon is confined within a small angle Theta, as shown in FIG. 1 which satisfies specifications of the U.S. Federal Aviation Agency. As shown in FIG. 4, some of the LEDs 16 can be of a color different from the others, either so that the beacon can generate flashes of white light composed of primary colors, or so that the beacon can flash different colors alternately.

A number of preferred practical embodiments are shown in FIGS. 5 to 11.

Figure 5:
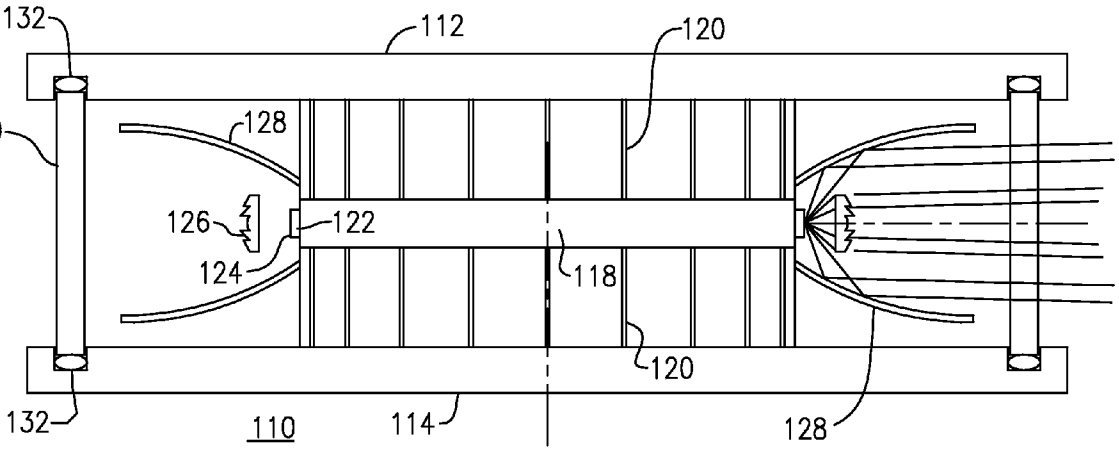
FIG. 5 is a vertical cross section of a beacon incorporating the optical components as illustrated in FIG. 4 and capable of generating a generally flat plane of light with one or more colors, here shown with a top cover, a bottom cover, a heat sink and a light transmitting window with seals.

Initially, the embodiment of the beacon or light generator 110 as shown in FIG. 5 comprises an upper cover 112 and a lower cover 114, each being generally in the form of a metal disk or circular plate, spaced apart one above the other. Between these is a heat sink arrangement 118 on which the circle or ring of LEDs 122 is mounted. The LEDs have their light emitting surface 124 on the radially outer side. Upper and lower cooling features 120 and 120 extend between the heat sink arrangement 118 and the respective upper and lower covers 112, 114. These cooling features may take the form of cooling fins, heat pipes, or solid-state heat transfer elements (e.g., Peltier effect), depending on design preferences. A Fresnel ring or cylindrical collimating lens 129 is spaced radially beyond the LEDs 122 and directs the central portion of the emitted light generally parallel to the horizontal plane, as discussed previously. Also, there are upper and lower reflectors 128, as discussed earlier, which have a generally horizontal parabolic shape as seen in cross section but which extend around the arc or circle of LEDs 122.

As seen in FIG. 5, at or near the peripheral edges of the upper and lower covers 112 and 114 a cylindrical clear lens cover 130 is held in annular channels and is sealed with upper and lower seal rings 132. This cover 130 serves to form an environmental seal to exclude dust, rainfall, corrosive chemicals, insects, and the like.

Figure 6:
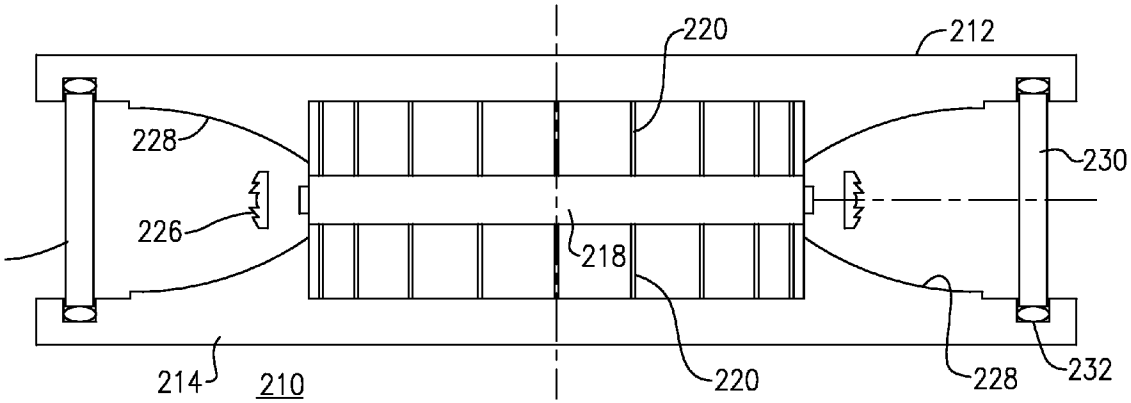
FIG. 6 is a vertical cross section similar to FIG. 5 wherein the reflector portion of the light engine is integrated as surfaces of the top and bottom covers.

Another similar embodiment is shown in FIG. 6, where elements similar to those in FIG. 5 are identified by similar reference numbers, but raised to the 200's. Each succeeding embodiment will have corresponding reference numbers raised to the next hundred.

In this embodiment, the reflectors are not provided as separate elements, but rather the parabolic reflective surfaces 228 are incorporated into the upper cover 212 and lower cover 214, and are integral with them. The heat sink 218 and associated cooling features 220 conduct any waste heat from the LEDs directly to the metal covers 212 and 213. The outer clear cover 230 is mounted between the upper and lower covers as discussed previously in respect to FIG. 5. The Fresnel collimating lens 226 functions and is positioned as described earlier.

Figure 7:
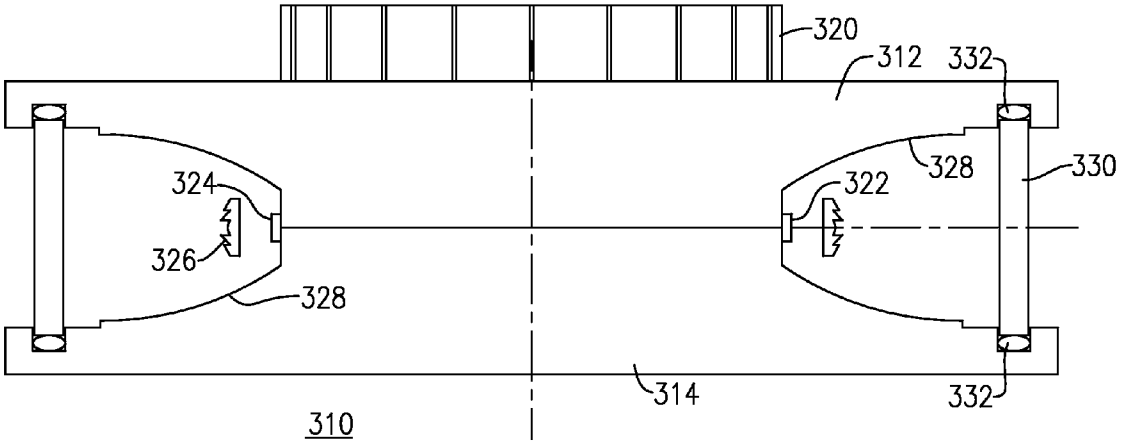
FIG. 7 is a cross section similar to FIG. 6 wherein the heat sink for the device is integrated with the covers of the beacon, rather than the heat sink being a separate component.

Another embodiment of a beacon or light generator 310 is shown in FIG. 7 and elements corresponding to the earlier described embodiment(s) are identified with reference numbers that are similar to those used earlier, but raised to the 300's. The beacon 310 has top and bottom covers 312 and 314 into which parabolic reflective surfaces 328, 328 are formed, respectively. Light from central part of the light beam of the LEDs passes through the Fresnel lens 326 is concentrated in the horizontal direction. Parabolic reflection surfaces extend radially beyond the collimating lens 328, and are configured so that light from the LED's that passes above or below the upper and lower limits of the lens 326 is redirected to the horizontal by the parabolic reflective surfaces 328, 328 that lie radially beyond the lens. The clear lens cover 330 encircles the LEDs, Fresnel lens, and reflective surfaces, as in the earlier-described embodiments. In this embodiment, cooling features 320 are situated above the upper surface of the top cover 312.

Figure 8:
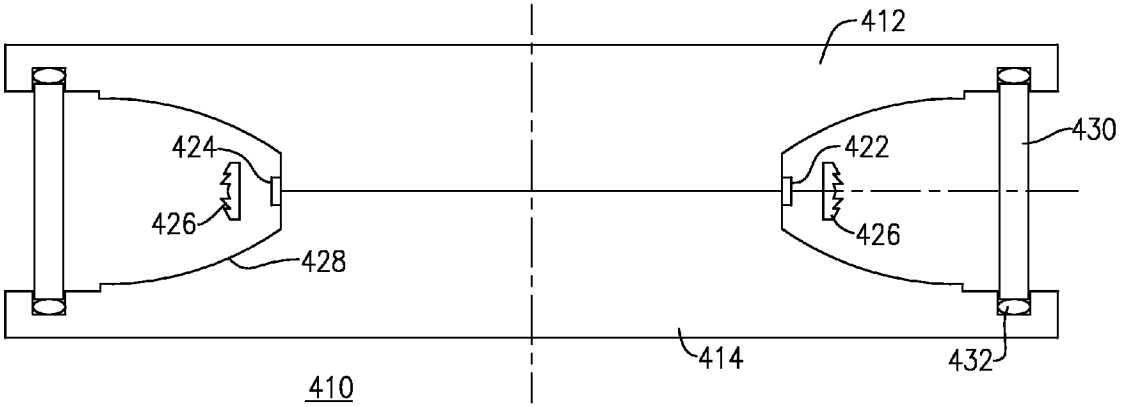
FIG. 8 is a cross section of a preferred embodiment with integrated top and bottom covers with integral heat sink without heat radiation fins, which may or may not be required based on the power consumption of the light generating elements.

The embodiment of the beacon 410 is shown in FIG. 8 with features similar to other embodiments are identified with similar reference numbers, but raised into the 400s. In this embodiment there are no external or internal cooling members, and all heat dissipation from the LEDs 422 is carried out by the metal top and bottom covers 412, 414. The Fresnel lens 426 concentrates the central part of the light from the light emitting surfaces 424 of the LEDs 422, as discussed earlier, and the remaining light is redirected horizontally by the reflective surfaces 428.

Figure 9:
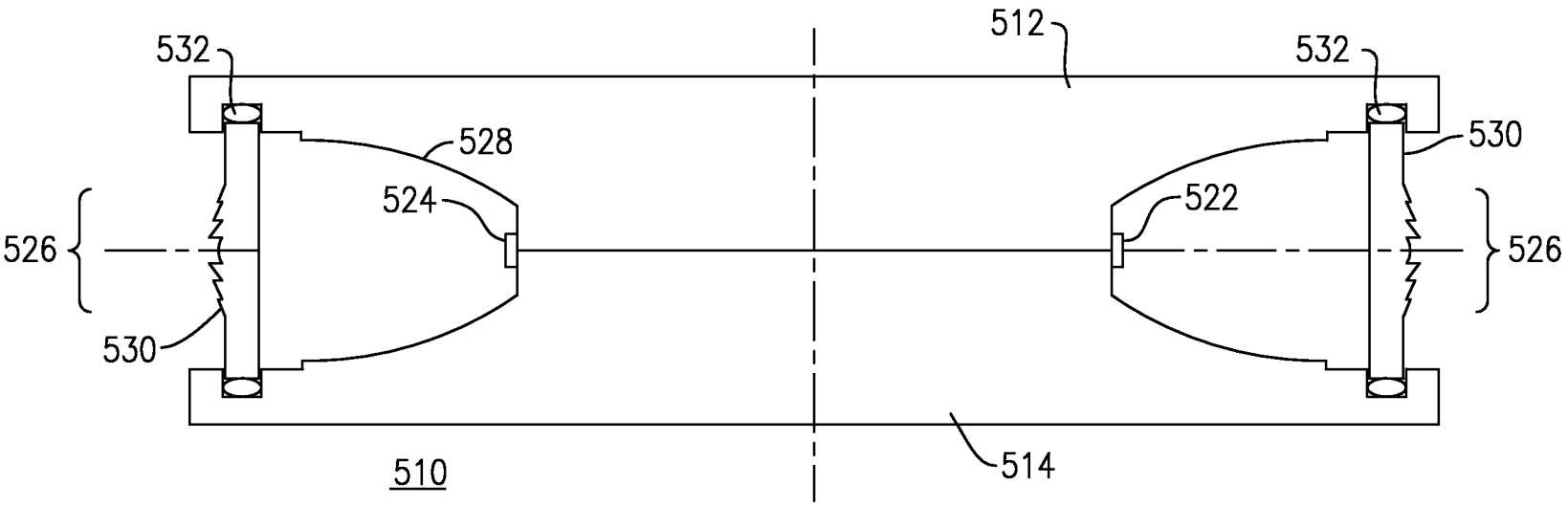
FIG. 9 is a cross section of an alternate preferred embodiment wherein a Fresnel collimating lens is incorporated with the transparent window.

FIG. 9 shows another related embodiment, where elements corresponding to those described earlier are identified with similar reference numbers, but raised into the 500s. Here, the covers 512, 514, LEDs 522 and reflective surfaces 520 are constructed as in the earlier-described embodiments, and perform in the same way. However, the separate Fresnel collimating lens is omitted, and is replaced by a collimating series of Fresnel cylindrical prisms 526 that are incorporated into a center portion of the clear cover lens 530, which is held in place between the top and bottom covers and environmentally sealed with a seal ring 532.

The beacons as shown and described in these embodiments may be provided with LEDs or equivalent light producing elements to produce different colors of light, e.g., red light and white light, either simultaneously or alternately. The number of color light sources can vary depending on the installation design. In some beacons, the LEDs on one half may emit one color, while those in the other half emit a different color.

Figure 10:
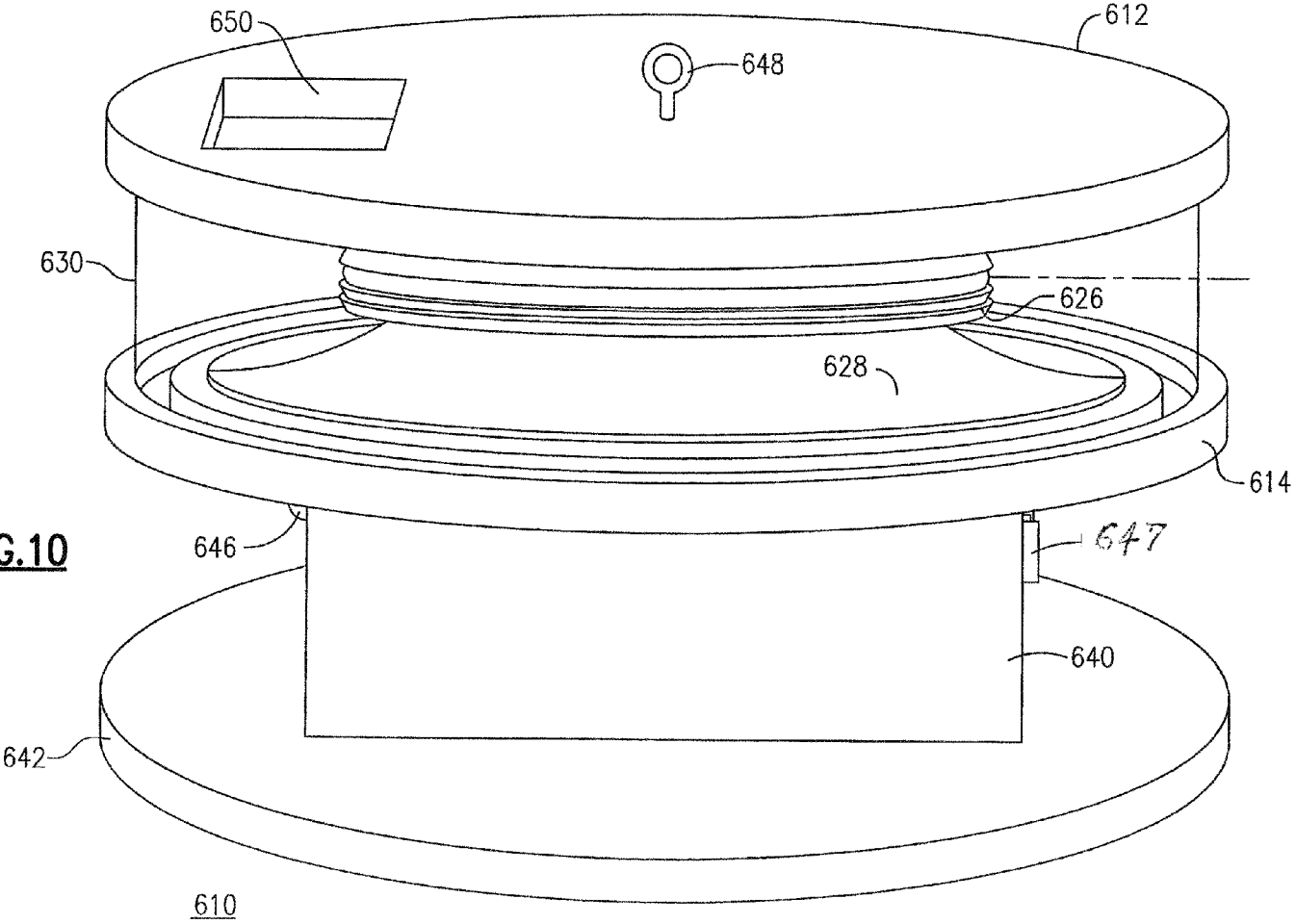
FIG. 10 is a perspective view of another preferred embodiment of the light beacon incorporating an electrical box, mounting plate, lifting hook and optional cavity for other devices such as antenna for wireless communications or Global Positioning System (GPS).

FIG. 10 is a perspective view of a practical arrangement of this beacon 610, which here is shown with its top cover 612 and bottom cover 614 and the captured cylindrical clear cover lens 630, and with the Fresnel cylindrical collimating lens 626 and the lower reflector 628 (the upper reflector being obscured in this view). In this particular embodiment, there is a bottom plate 642 that supports an enclosure 640 that serves as a housing for the electrical drive circuitry for the LEDs or other light emitting devices used in the beacon. A hinge 646 is shown on the left joining the top of the enclosure 640 to the bottom cover 614, and a releasable clamp 647 is shown on the right to keep the bottom cover closed securely on the enclosure. When the clamp 647 is released, the bottom plate and the remainder of the beacon assembly can be rotated to lift out electrical components from the enclosure 640 for repair or maintenance. Also, the In this embodiment a recess 650 may be provided on the top cover 612 as a location for a satellite geo-positioning device or other communications device. An eye bolt 648 is provided to facilitate lifting the beacon for mounting onto a tall structure such as a tower, chimney, or stack. The bottom plate 642 can serve as a mounting flange for mounting the beacon assembly to the associated tower, chimney or stack.

Figure 11:
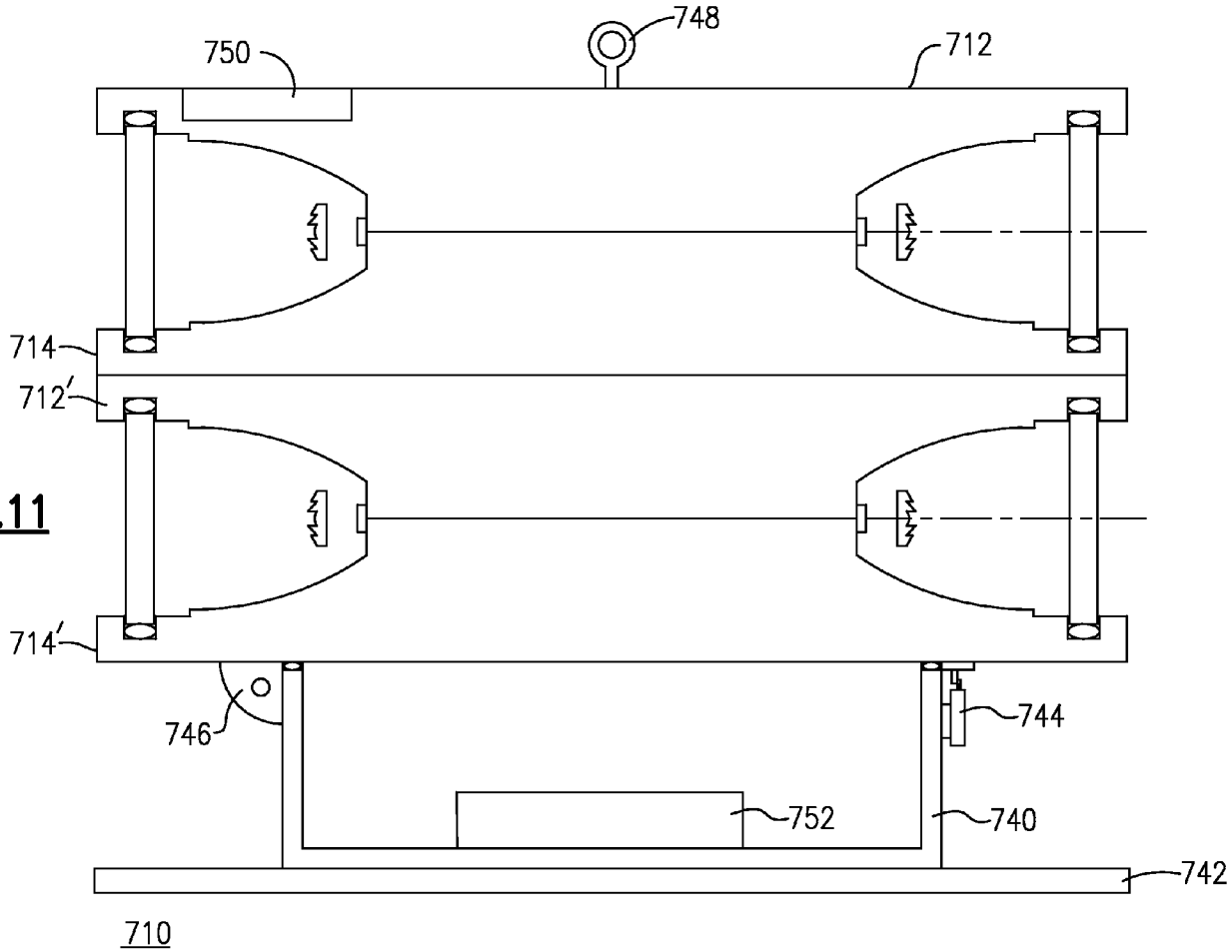
FIG. 11 is a cross section of a stacked arrangement by which a beacon light devices of the previously described embodiments can be stacked to produce a beacon light with higher light intensity or other advantageous features.

A superposed double-beacon or twin-beacon embodiment 710 is shown in FIG. 11, wherein there are upper and lower beacons stacked immediately one above the other, each constructed and operating in the fashion described earlier. Here the double-beacon has first top cover 712 and an associated first bottom cover 714, that pair up to define an annual cavity containing the LEDs or other illumination sources, the Fresnel cylindrical collimating lens, and the upper and lower reflective surfaces as described in detail earlier, and with the associated clear cover lens. The first bottom cover 714 is affixed onto a second top cover 712', which is mated with a second bottom cover 714' immediately below it, and with the LEDs, collimating lens, and reflective surfaces also as earlier described. In some versions of this arrangement, the covers 714 and 712' can be formed in one piece, i.e., unitary with one another. While the two beacons are shown to be equal in size, this is not a necessary requirement, and the lower one can be smaller or larger, depending on the application.

As in the embodiment of FIG. 10, this embodiment has a lower plate 742 with an electrical enclosure 740, here shown with an electrical circuit board 752 disposed within it. A hinge 746 connects the enclosure 740 to one side of the cover 714' and, as in the earlier embodiment, clamp 744 holds the lower beacon bottom cover 714' closed and environmentally sealed against the enclosure 740. A recess 750 for a G.P.S. device or the like, and an eyebolt 748 are provided as discussed earlier.

The invention is not limited to the foregoing embodiments, and many modifications and variations are possible without departing from the main concept. Rather the scope of this invention is defined in the appended claims.

What is claimed is:

1. A beacon that emits a substantially flat horizontal disk of light along a horizontal plane, comprising:

a top cover and a bottom cover, each situated to be centered on a vertical axis of the beacon;

a plurality of light-emitting elements arranged in a ring situated between said top cover and said bottom cover, and each of said light-emitting elements having a light-emitting surface (LES) facing radially outward in respect to said vertical axis;

upper and lower reflective surfaces integrated into the lower side of the top cover and into the upper side of the lower cover, respectively; each of said reflective surfaces being a surface of rotation, about said vertical axis, of a horizontal parabola whose focus lies substantially on said ring of said light-emitting elements; and a cylindrical collimating lens centered on said vertical axis and lying radially outside said ring of said light-emitting elements, said cylindrical collimating lens having an upper limit and a lower limit, wherein said upper and lower reflective surfaces extend radially beyond said cylindrical collimating lens and are spaced above and below said upper and lower limits thereof, respectively, such that the lens collimates a center portion of the light emanating from the LES of said light-emitting elements onto said horizontal plane, and light thereof outside said center portion and above said upper limit and below said lower limit impinging upon said upper and lower reflective surfaces, respectively, and being directed therefrom substantially parallel to said horizontal plane.

2. A beacon according to claim 1 wherein said light-emitting elements all emit a single color.

3. A beacon according to claim 1 where a portion of said plurality of light emitting elements emit light of one color and another portion of said plurality of light emitting elements emit light of a different color.

4. A beacon according to claim 1 wherein said beacon incorporates a heat sink into one or both of said top and bottom covers.

5. A beacon according to claim 1 wherein said reflective surfaces, said ring of said light-emitting elements and said cylindrical collimating lens each extend in a full circle about said vertical axis.

6. A beacon according to claim 1 wherein said collimated light and said reflected light are visible for a predetermined angle θ from said horizontal plane.

7. A beacon according to claim 1 further comprising an outer cylindrical light-transmitting lens cover disposed radially beyond said cylindrical collimating lens, and sealably affixed onto radially outer portions of said top cover and said bottom cover.

8. A beacon according to claim 1 further comprising a mounting bracket affixed onto one or both of said top cover and said bottom cover, and adapted for attaching said beacon onto an elevated structure.

9. A beacon that emits substantially flat upper and lower horizontal disks of light along two or more respective horizontal planes, comprising:

a first top cover and a first bottom cover, each situated to be centered on a vertical axis of the beacon;

a first plurality of light-emitting elements arranged in a first ring situated between said first top and bottom covers, and each of said light-emitting elements thereof having a light-emitting surface (LES) facing radially outward in respect to said vertical axis;

first upper and lower reflective surfaces integrated into the lower side of the first top cover and into the upper side of the first lower cover, respectively; each of said first reflective surfaces being a surface of rotation, about said vertical axis, of a horizontal parabola whose focus lies on said ring of said light-emitting elements;

a first cylindrical collimating lens centered on said vertical axis and lying radially outside said ring of said first plurality of light-emitting elements, said first cylindrical collimating lens having an upper limit and a lower limit, wherein said first upper and lower reflective surfaces extend radially beyond said first cylindrical collimating lens and are spaced above and below said upper and lower limits thereof respectively such that the lens collimates a center portion of the light emanating from the LES of said light-emitting elements onto the first horizontal plane, and with light thereof outside said center portion impinging upon said first upper and lower reflective surfaces and being directed therefrom substantially parallel to said first horizontal plane;

at least a second top cover and a second bottom cover, each situated to be centered on the vertical axis of the beacon, said second top cover being situated adjacent the first lower cover;

at least a second plurality of light-emitting elements arranged in a second ring which is situated between said second top and bottom covers, and each of said light-emitting elements thereof having a light-emitting surface (LES) facing radially outward in respect to said vertical axis;

second upper and lower reflective surfaces integrated into the lower side of the second top cover and into the upper side of the second lower cover, respectively, each of said second reflective surfaces being a surface of rotation, about said vertical axis, of a horizontal parabola whose focus lies substantially on said second ring of said light-emitting elements;

at least a second cylindrical collimating lens centered on said vertical axis and lying radially outside said second ring of said second plurality of light-emitting elements, said second cylindrical collimating lens having an upper limit and a lower limit, wherein said second upper and lower reflective surfaces extend radially beyond said second cylindrical collimating lens and are spaced above and below said upper and lower limits thereof, respectively such that the second cylindrical collimating lens collimates a center portion of the light emanating from the LES of said light-emitting elements onto the second horizontal plane, and with light thereof outside said center portion impinging upon said second upper and lower reflective surfaces and being directed therefrom substantially parallel to said second horizontal plane.

10. A beacon according to claim 9 further comprising at least an additional set of top and bottom covers, an additional plurality of light-emitting elements, an additional associated set of upper and lower reflective surfaces, and an additional associated cylindrical collimating lens, arranged to provide light in an additional horizontal plane parallel to said second horizontal plane.

11. A beacon according to claim 9 wherein said light-emitting elements of each of said first and second plurality of thereof all emit a respective single color, and the light-emitting elements of the first plurality thereof emit one predetermined color and the light-emitting elements of the second plurality thereof emit a different predetermined color.

12. A beacon according to claim 9 wherein said light-emitting elements are LEDs, and the LEDs of said first and second plurality thereof all emit a single color, and the LEDs of the first plurality of LEDs emit one predetermined color and the LEDs of the second plurality of LEDs emit the same predetermined color.

13. A beacon according to claim 9 wherein said light-emitting elements of each of said first and second plurality of light-emitting elements each emit a combination of different color wavelengths.

14. A beacon according to claim 9 comprising an electronic drive arrangement providing power to the light-emitting elements of said first and second pluralities thereof of the beacon for illuminating the same, and wherein said electronic drive arrangement provides said power intermittently to each of said first and second pluralities of said light-emitting elements and is adapted to illuminate said first and second pluralities thereof alternately in a programmed pattern.

* * * * *